US009791800B2

(12) United States Patent
Takayama et al.

(10) Patent No.: US 9,791,800 B2
(45) Date of Patent: Oct. 17, 2017

(54) CHARGING DEVICE AND IMAGE FORMING APPARATUS HAVING A ROTATION MEMBER WITH A SPIRAL PROTRUSION

(71) Applicant: FUJI XEROX CO., LTD., Tokyo (JP)

(72) Inventors: Yasuo Takayama, Ebina (JP); Sadao Okano, Ebina (JP); Akiko Kimura, Ebina (JP); Yusuke Kitagawa, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/241,809

(22) Filed: Aug. 19, 2016

(65) Prior Publication Data

US 2017/0205729 A1 Jul. 20, 2017

(30) Foreign Application Priority Data

Jan. 19, 2016 (JP) ..... 2016-007851

(51) Int. Cl.
*G03G 15/02* (2006.01)

(52) U.S. Cl.
CPC ..... *G03G 15/0291* (2013.01)

(58) Field of Classification Search
CPC ..... G03G 15/0225; G03G 15/0258; G03G 15/0291
USPC ..... 399/100
See application file for complete search history.

(56) References Cited

U.S. PATENT DOCUMENTS 6,768,885 B2 * 7/2004 Shimizu ..... G03G 15/0258 399/100
7,978,990 B2 * 7/2011 Tajima ..... G03G 15/0258 399/100
8,577,247 B2 * 11/2013 Kimura et al. .... G03G 15/0258 399/100
8,923,724 B2 * 12/2014 Hoshino et al. ... G03G 15/0258 399/100

FOREIGN PATENT DOCUMENTS

JP H04-101561 U 9/1992
JP 2007-057815 A 3/2007

* cited by examiner

*Primary Examiner* — William J Royer
(74) *Attorney, Agent, or Firm* — Oliff PLC

(57) ABSTRACT

A charging device includes: an electrode; a cleaning member that cleans the electrode; a moving body that moves along the electrode, the cleaning member that is attached to the moving body; and a rotation member that is disposed along the electrode and that includes a spiral protrusion on an outer circumferential surface thereof to move the moving body, the rotation member that is rotated in a circumferential direction. A plurality of kinds of pitch intervals of the protrusion are provided on at least a central portion of the rotation member in a longitudinal direction.

7 Claims, 13 Drawing Sheets

CHARGING DEVICE AND IMAGE FORMING APPARATUS HAVING A ROTATION MEMBER WITH A SPIRAL PROTRUSION

CROSS-REFERENCE TO RELATED APPLICATIONS

This application is based on and claims priority under 35 USC 119 from Japanese Patent Application No. 2016-007851 filed Jan. 19, 2016.

BACKGROUND

The present invention relates to a charging device and an image forming apparatus.

SUMMARY

According to an aspect of the invention, a charging device includes: an electrode; a cleaning member that cleans the electrode; a moving body that moves along the electrode, the cleaning member that is attached to the moving body; and a rotation member that is disposed along the electrode and that includes a spiral protrusion on an outer circumferential surface thereof to move the moving body, the rotation member that is rotated in a circumferential direction. A plurality of kinds of pitch intervals of the protrusion are provided on at least a central portion of the rotation member in a longitudinal direction.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described in detail with reference to the accompanying drawings.

Figure 1:
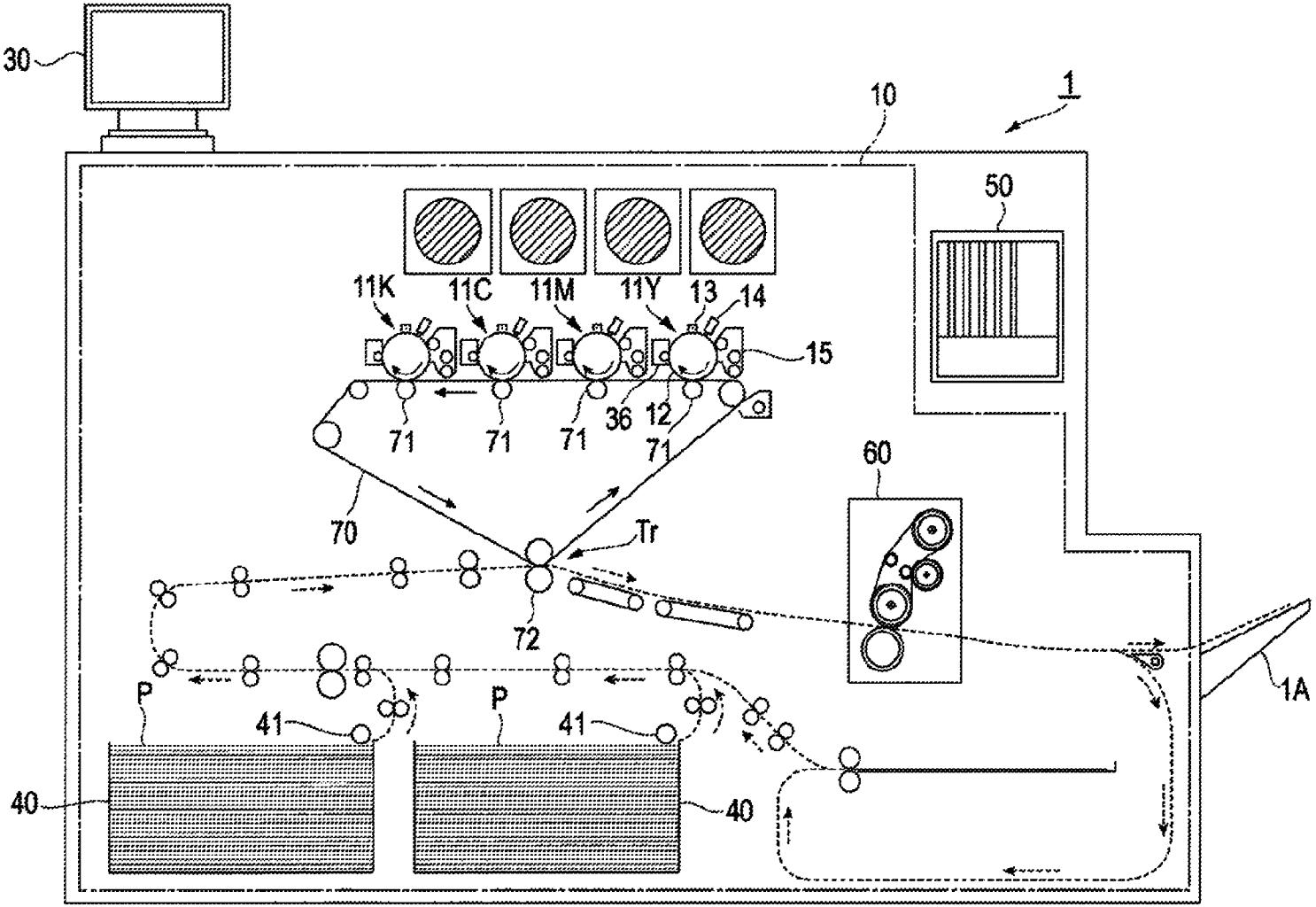
FIG. 1 is a view illustrating a configuration example of an image forming apparatus according to a present exemplary embodiment.

FIG. 1 is a view illustrating a configuration example of an image forming apparatus 1 according to an exemplary embodiment.

The image forming apparatus 1 illustrated in FIG. 1 is a so-called tandem type color printer, and includes an image forming section 10 that forms an image based on image data. In addition, the image forming apparatus 1 is provided with a main controller 50.

The main controller 50 includes a program-controlled central processing unit (CPU), and performs the operation control of each device or each functional unit provided in the image forming apparatus 1, communication with a personal computer or the like, or processing of image data or the like.

In addition, the image forming apparatus 1 is provided with a user interface unit 30 that receives operation input from a user, or displays a variety of information regarding the user.

As an example of an image forming section, the image forming section 10 is a functional section configured to form an image by, for example, an electrophotographic process, and includes four image forming units, such as a yellow (Y) image forming unit 11Y, a magenta (M) image forming unit 11M, a cyan (C) image forming unit 11C, and a black (K) image forming unit 11K.

In addition, in the following description, the respective image forming units are referred to as "image forming units 11" when they need not to be distinguished.

The respective image forming units 11, which include the image forming unit 11Y, the image forming unit 11M, the image forming unit 11C, and the image forming unit 11K, form a yellow toner image, a magenta toner image, a cyan toner image, and a black toner image, respectively.

Each of the image forming units 11 is provided with a photoconductor drum 12 as an example of an image carrier. The photoconductor drum 12 has a cylindrical shape, is provided rotatably, and holds a toner image formed on an outer circumferential surface thereof. More specifically, in the present exemplary embodiment, an electrostatic latent image is formed on the surface of the photoconductor drum 12, and subsequently, developing by a toner is performed. As such, a toner image is formed on the surface of the photoconductor drum 12, and this toner image is temporarily held by the photoconductor drum 12.

In addition, each of the image forming units 11 is provided with a charging device 13 that charges the surface of the photoconductor drum 12, and an exposure device 14 that exposes, based on image data, the photoconductor drum 12 charged by the charging device 13.

In addition, each of the image forming units 11 is provided with a developing device 15 that develops an electrostatic latent image formed on the photoconductor drum 12 using toners of respective colors, and a cleaner 36 that cleans the surface of the photoconductor drum 12 after transfer.

In addition, the respective image forming units 11 have the same configuration, except for the toner accommodated in the developing device 15.

In addition, the image forming section 10 is provided with an intermediate transfer belt 70, to which toner images of respective colors formed on the photoconductor drums 12 of the respective image forming units 11 are transferred, and a primary transfer roll 71 that transfers (primarily transfer) the toner images of respective colors formed by the respective image forming units 11 to the intermediate transfer belt 70.

In addition, the image forming section 10 is provided with a secondary transfer roll 72 that collectively transfers (secondarily transfers) the toner images of respective colors, which have been transferred to the intermediate transfer belt 70 to be superposed with each other, to a recording medium P, such as paper. In addition, a fixing device 60 is provided to fix the secondarily transferred toner images of respective colors to the recording medium P.

In addition, in the present exemplary embodiment, an area in which the secondary transfer roll 72 is located and the toner images of respective colors on the intermediate transfer belt 70 are secondarily transferred to the recording medium P is hereinafter referred to as a secondary transfer area Tr.

An operation of the image forming apparatus 1 will be described.

In image forming, the respective image forming units 11 form toner images of respective colors, including black, cyan, magenta, and yellow, via an electrophotography process.

The toner images of respective colors, which are formed by the respective image forming units 11, are primarily transferred to the intermediate transfer belt 70 by the primary transfer rolls 71 in sequence such that the toner images, in which respective color toners are superposed with each other, are formed on the intermediate transfer belt 70.

The toner images on the intermediate transfer belt 70 are transported to the secondary transfer area Tr in which the secondary transfer roll 72 is located, as the intermediate transfer belt 70 moves.

In a recording medium transport system, the recording medium P taken from a recording medium accommodating container 40 by a delivery roll 41 is transported along a transport path, and reaches the secondary transfer area Tr.

In the secondary transfer area Tr, the toner images on the intermediate transfer belt 70 are collectively secondarily transferred to the recording medium P by a transfer electric field formed by the secondary transfer roll 72.

Thereafter, the recording medium P, to which the toner images have been transferred, is separated from the intermediate transfer belt 70, and is transported to the fixing device 60 along the transport path.

The toner images on the recording medium P transported to the fixing device 60 are fixed to the recording medium P by the fixing device 60. Thereafter, the recording medium P is transported to a recording medium discharge unit 1A.

Figure 2:
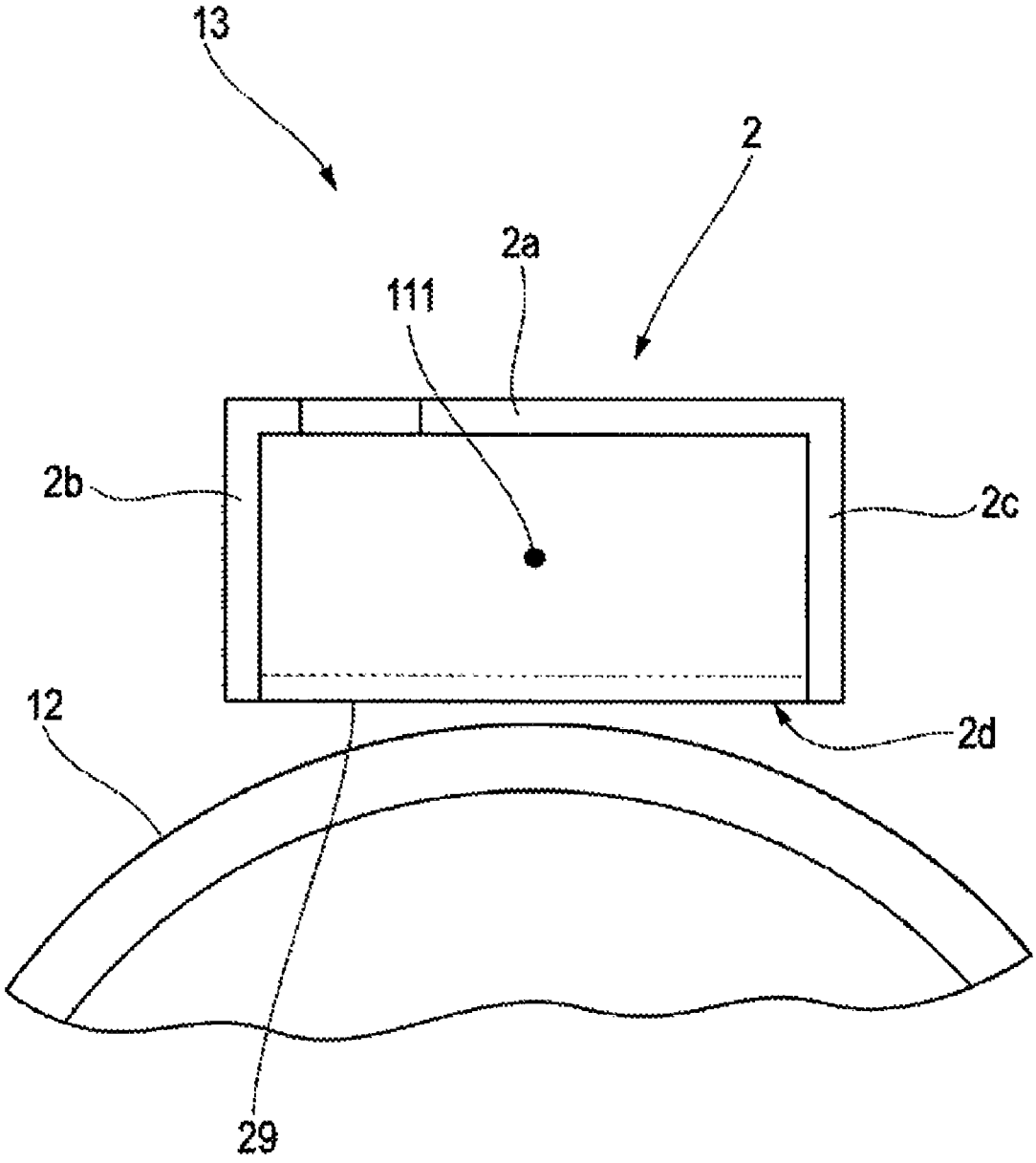
FIG. 2 is an enlarged view illustrating a charging device.
Figure 3:
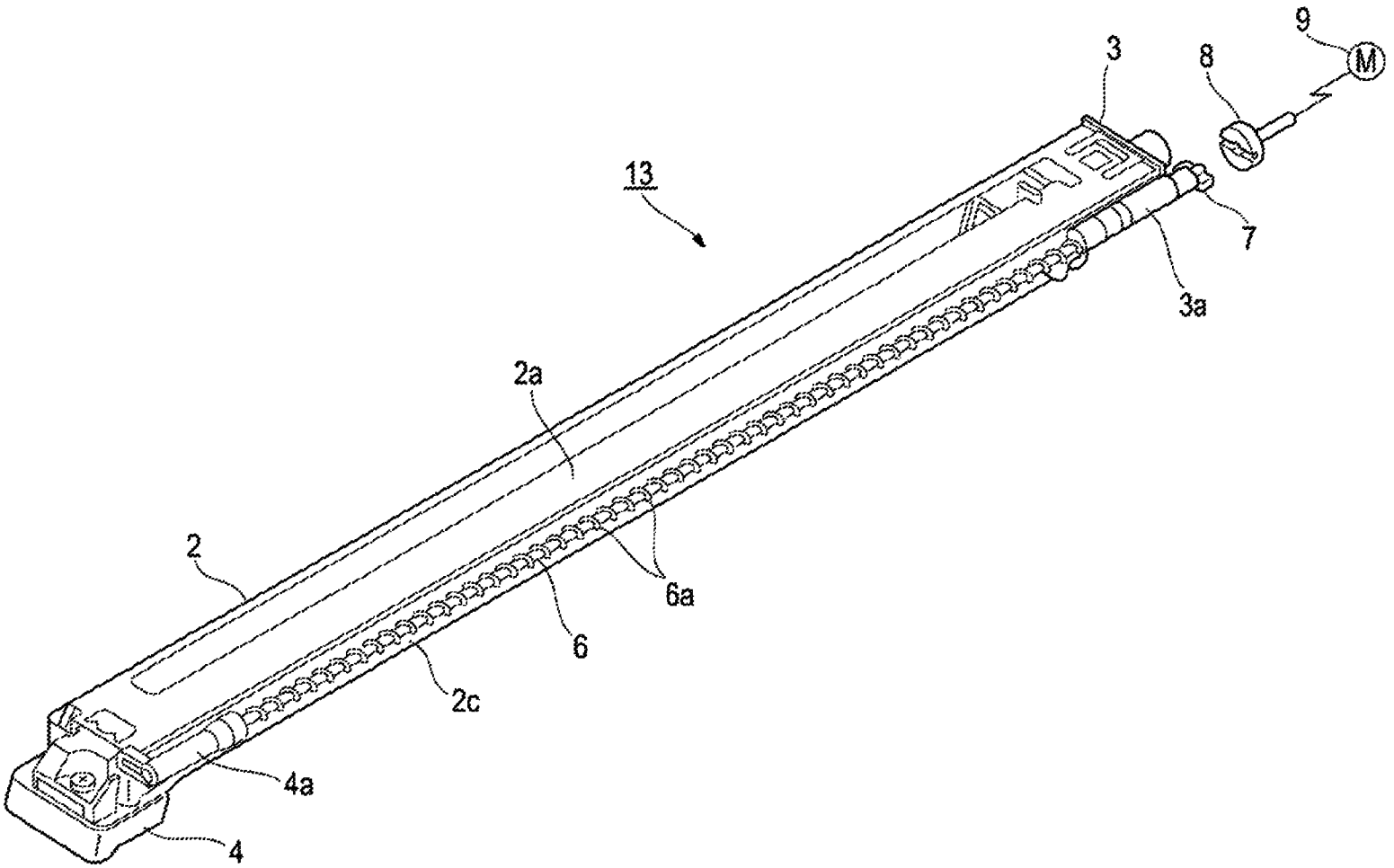
FIG. 3 is a perspective view of the charging device.

FIG. 2 is a view illustrating the charging device 13 in an enlarged scale. In addition, FIG. 3 is a perspective view of the charging device 13. The charging device 13 will be described based on FIGS. 2 and 3.

As illustrated in FIG. 2, the charging device 13 is provided with a shield electrode 2, which extends in the front-and-rear direction of the image forming apparatus 1 (see FIG. 1) (i.e. which extends in the depth direction of the image forming apparatus 1 or extends in the direction perpendicular to the paper surface of FIG. 2). In other words, the charging device 13 is provided with the shield electrode 2, which extends in the axial direction of the photoconductor drum 12. The shield electrode 2 is opened at the photoconductor drum 12 side.

The shield electrode 2 is formed of a metal material. In addition, the shield electrode 2 is provided with a plate-shaped top wall portion 2*a*, which extends in the front-and-rear direction of the image forming apparatus 1, and plate-shaped left and right sidewall portions 2*b* and 2*c*, which extend downward from left and right sides of the top wall portion 2*a*, respectively.

As illustrated in FIG. 3, a rear end block 3 is attached to a rear end (one end portion) of the shield electrode 2, and a front end block 4 is attached to a front end (the other end portion) of the shield electrode 2.

The rear end block 3 and the front end block 4 (the right upper portions of the rear end block 3 and the front end block 4 in the drawing) are respectively provided with shaft accommodating portions 3*a* and 4*a*, which have a cylindrical shape and extend in the front-and-rear direction.

In the present exemplary embodiment, the shaft 6, which extends in the front-and-rear direction, is supported in a rotatable state by the shaft accommodating portions 3*a* and 4*a*. In addition, in the present exemplary embodiment, both end portions of the shaft 6 are supported by the shaft accommodating portions 3*a* and 4*a*. As an example of a rotating member, the shaft 6 is disposed along the shield electrode 2 or a wire electrode 111 to be described later.

In addition, a spiral protrusion 6*a* is provided on an outer circumferential surface of the shaft 6 in order to move a moving body 100 (to be described below in FIG. 4).

The protrusion 6*a* is formed by a wire material. In the present exemplary embodiment, the shaft 6 with the protrusion 6*a* is formed by winding the wire material on an outer circumferential surface of a bar-shaped member (a rod member), and then fixing the wire material to the bar-shaped member via, for example, welding. In addition, either the bar-shaped member or the wire material is made of a metal.

In addition, the shaft 6 may be formed by passing a bar-shaped member through a spiral coil, and then fixing the coil to the bar-shaped member via welding or the like.

A rear end portion of the shaft 6 extends rearward through the inside of the shaft accommodating portion 3*a*, and a driven coupling 7 is attached to the rear end portion of the shaft 6. The driven coupling 7 is connected to a driving coupling 8 provided on the main body side of the image forming apparatus 1.

In the present exemplary embodiment, rotation drive power is supplied from the driving coupling 8, which is rotated by a motor 9, to the driven coupling 7, so that the shaft 6 is rotated in the circumferential direction.

As illustrated in FIG. 2, the wire electrode 111 is provided inside the shield electrode 2.

As an example of an electrode, the wire electrode 111 is disposed opposite to the outer circumferential surface of the photoconductor drum 12, and is also disposed along the axial direction of the photoconductor drum 12.

In addition, the wire electrode 111 is configured with a wire material. In addition, the wire electrode 111 is fixed, at one end portion thereof in the front-and-rear direction, to the front end block 4 (see FIG. 3), and, at the other end portion thereof to the rear end block 3.

In addition, as illustrated in FIG. 2, a grid electrode 29 is provided in an opening 2*d* of the shield electrode 2.

The grid electrode 29 is disposed so as to extend in the front-and-rear direction (the axial direction of the photoconductor drum 12). In addition, the grid electrode 29 is formed of a thin film-shaped (plate-shaped) metal.

Plural through-holes are formed in the grid electrode 29. A portion provided with the through-holes is formed in the form of a mesh. In addition, the grid electrode 29 is supported by the front end block 4 (see FIG. 3) and the rear end block 3.

In addition, the grid electrode 29 is tensioned in the longitudinal direction by the front end block 4 and the rear end block 3, and tensile force is applied to the grid electrode 29.

In the present exemplary embodiment, a voltage is applied between the wire electrode 111 and the shield electrode 2 and between the wire electrode 111 and the grid electrode 29 such that a potential difference is generated between the wire electrode 111 and the shield electrode 2, and a potential difference is generated between the wire electrode 111 and the grid electrode 29.

Thus, electrons are emitted from the wire electrode 111, causing the surface of the photoconductor drum 12 to be charged.

Figure 4:
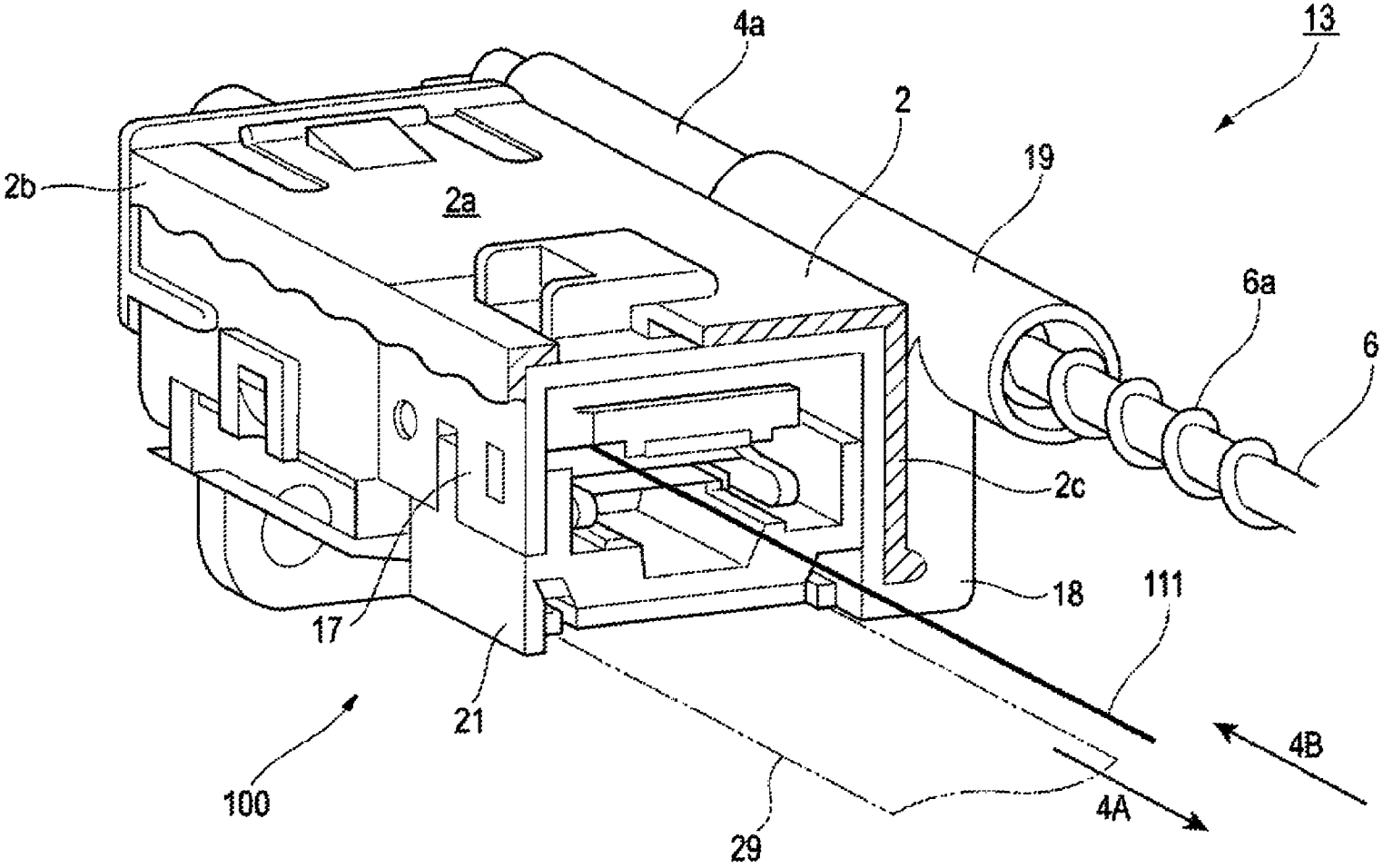
FIG. 4 is a view illustrating the internal structure of the charging device.
Figure 5:
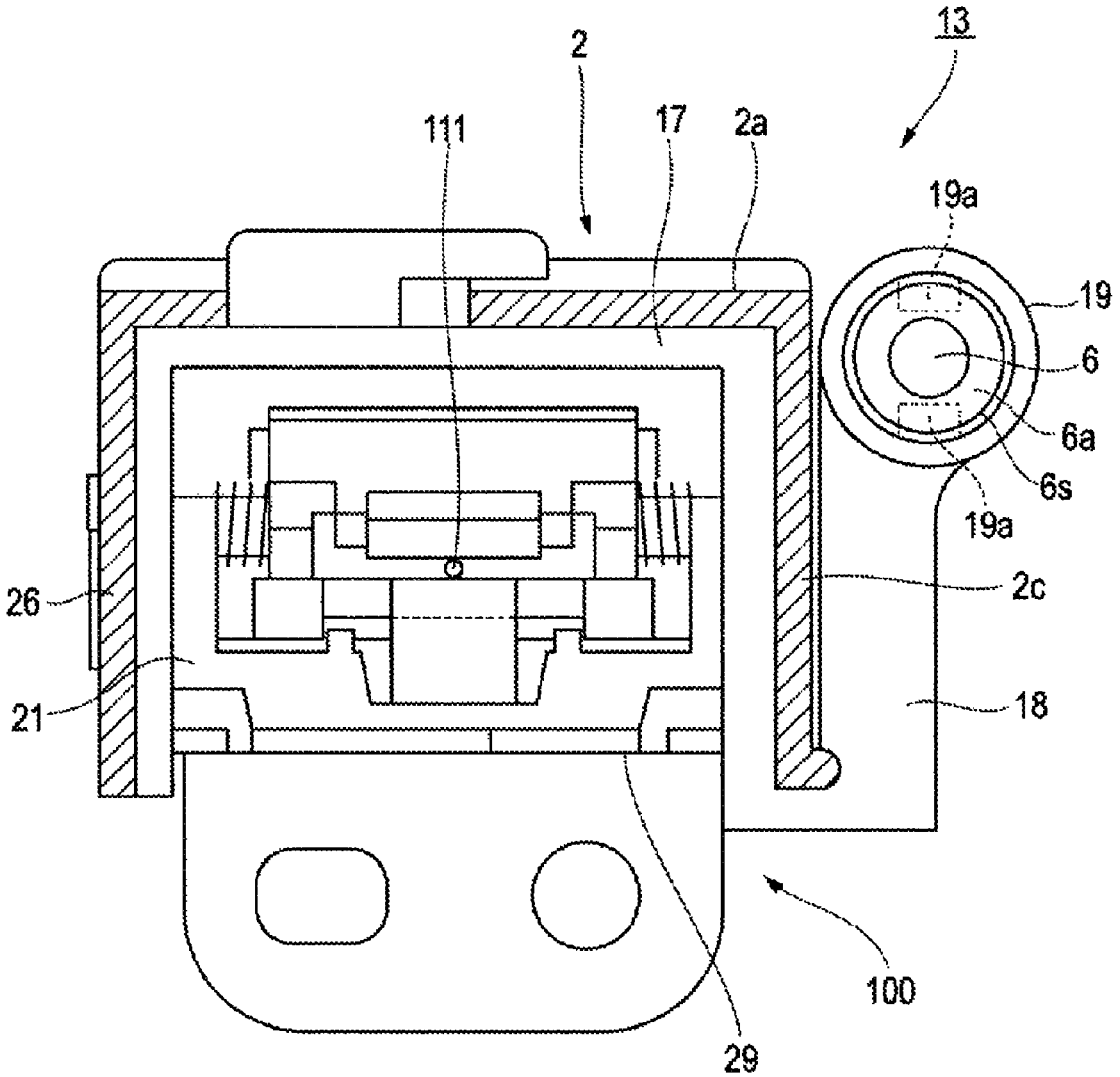
FIG. 5 is a sectional view of the charging device taken along the plane that is perpendicular to the front-and-rear direction.
Figure 6:
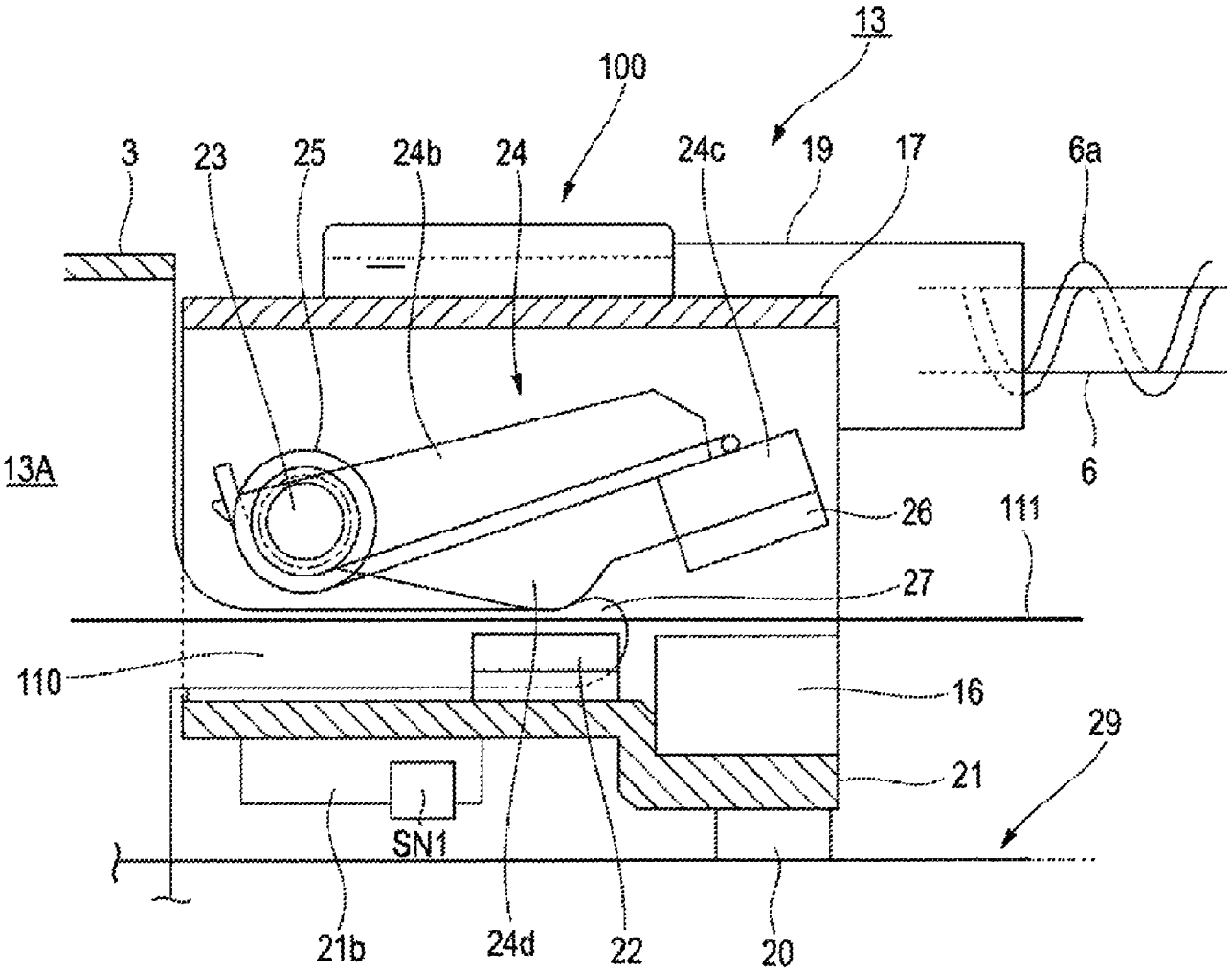
FIG. 6 is a sectional view of the charging device taken along the plane in the front-and-rear direction.

FIG. 4 is a view illustrating the internal structure of the charging device 13. FIG. 5 is a sectional view of the charging device 13 taken along the plane that is perpendicular to the front-and-rear direction. FIG. 6 is a sectional view of the charging device 13 taken along the plane in the front-and-rear direction.

As illustrated in FIG. 4, in the present exemplary embodiment, a moving body 100 is provided to move along the wire electrode 111 (in the front-and-rear direction).

The moving body 100 is located between the shield electrode 2 and the grid electrode 29. In addition, the moving body 100 includes an upper slider frame 17, a lower slider frame 21, and the like.

In addition, the moving body 100 is provided with a cylindrical shaft penetration portion 19, through which the shaft 6 penetrates, and a connection portion 18, which connects the shaft penetration portion 19 and the upper slider frame 17 to each other. Here, the upper slider frame 17, the connection portion 18, and the shaft penetration portion 19 are formed of a resin material, and in addition, are integrally formed with each other.

As illustrated in FIG. 5, on an inner circumferential surface of the shaft penetration portion 19, pressed portions 19*a* are provided which protrude from the inner circumferential surface, and are inserted between the turns of the protrusion 6*a*.

In the present exemplary embodiment, when the shaft 6 is rotated, the pressed portions 19*a* are pressed by the protrusion 6*a*. Thus, the moving body 100 is moved in the front-and-rear direction (in the longitudinal direction of the shaft 6). In other words, in the present exemplary embodiment, the rotation of the shaft 6 in a given direction and in a backward direction is performed such that the moving body 100 performs reciprocation.

FIG. 4 illustrates a state in which the moving body 100 is located at a home position.

When the shaft 6 is rotated in one direction from this state, the moving body 100 is moved in the direction represented by the arrow 4A in FIG. 4. In addition, when the shaft 6 is rotated in the reverse direction, the moving body 100 is moved in the direction represented by the arrow 4B in FIG. 4.

In the present exemplary embodiment, the wire electrode 111 and the grid electrode 29 are cleaned by the movements of the moving body 100 in the direction represented by the arrow 4A and the movements of the moving body 100 in the direction represented by the arrow 4B.

As illustrated in FIG. 6, a lower electrode cleaner 16 is provided inside the moving body 100 and is configured to clean the wire electrode 111 from below. The lower electrode cleaner 16 is supported from below by the lower slider frame 21.

In addition, the moving body 100 is provided with a grid cleaner 20.

The grid cleaner 20 performs the cleaning of the grid electrode 29 by coming into contact with the grid electrode 29. The grid cleaner 20 is, for example, configured with a so-called brush-shaped member in which cleaning bristles are planted in a base fabric. In addition, the grid cleaner 20 may have any other shape, such as a fabric shape, without being limited to the brush shape.

In addition, as illustrated in FIG. 6, the moving body 100 is provided with a lower wire cleaner 22, which is located opposite to the wire electrode 111.

In the present exemplary embodiment, as illustrated in FIG. 6, in a state in which the moving body 100 is located at a home position that is a reference position, the lower electrode cleaner 16 and the lower wire cleaner 22 are spaced apart from the wire electrode 111.

In addition, a plate-shaped detection target portion 21*b* is provided on a lower surface of the lower slider frame 21 to extend downward. In addition, a sensor SN1 for sensing the detection target portion 21*b* is located at a main body 13A side of the charging device 13. The sensor SN1 is provided at the home position, and senses that the moving body 100 is located at the home position by sensing the detection target portion 21*b*.

In addition, a shaft 23 is provided inside the moving body 100 to extend in the direction perpendicular to the front-and-rear direction. An upper cleaner support member 24 is supported by the shaft 23.

The upper cleaner support member 24 is provided with a pair of arm plate portions 24*b* (only one arm plate portion 24*b* is illustrated in FIG. 6), which is supported in a rotatable state by the shaft 23. One arm plate portion 24*b* is supported by one end portion of the shaft 23, and the other arm plate portion is supported by the other end portion of the shaft 23.

In addition, the upper cleaner support member 24 is provided with cleaner support portions 24*c*, which are attached to tip ends of the arm plate portions 24*b* and extend in the direction perpendicular to the front-and-rear direction.

An upper wire cleaner 26 is attached to a lower surface of the cleaner support portion 24*c*.

As an example of a cleaning member, the upper wire cleaner 26 performs the cleaning of the wire electrode 111 by coming into contact with the wire electrode 111 from above the wire electrode 111.

A plate protruding portion 24*d*, which protrudes downward, is provided on a lower portion of the arm plate portion 24*b*.

In addition, a block protruding portion 110 is provided on the rear end block 3 (at the main body 13A side of the charging device 13) to protrude toward the front end block 4 (see FIG. 3). The block protruding portion 110 is provided with an upper protrusion 27, which protrudes upwardly, at the tip end in the protruding direction thereof.

In addition, in the present exemplary embodiment, a torsion spring 25 is provided to press the upper wire cleaner 26 against the wire electrode 111 by rotating the upper cleaner support member 24 in the clockwise direction of the drawing about the shaft 23.

Figure 7:
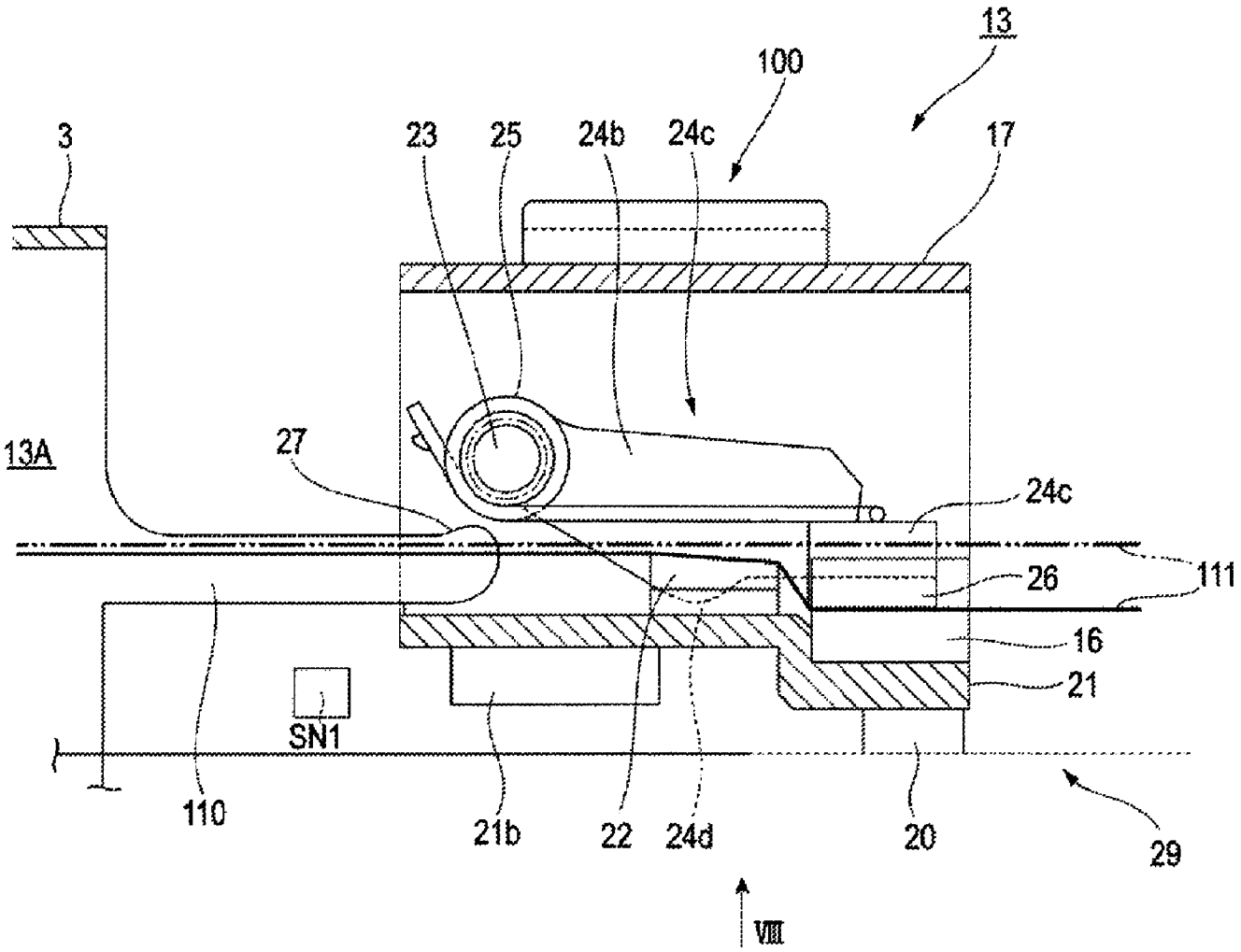
FIG. 7 is a view illustrating a state after a moving body is moved forward.

FIG. 7 is a view illustrating a state after the moving body 100 is moved forward. In other words, the drawing illustrates the state after the moving body 100 is moved toward the front end block 4 (see FIG. 3).

In the present exemplary embodiment, when the motor 9 (see FIG. 3) is driven, the moving body 100 is moved forward (toward the front end block 4). Thus, as illustrated in FIG. 7, the plate protruding portion 24*d* is moved farther forward than the upper protrusion 27 such that the upper cleaner support member 24 is rotated in the clockwise direction about the shaft 23.

When the upper cleaner support member 24 is rotated in the clockwise direction, the upper wire cleaner 26 is pressed against the wire electrode 111 from above the wire electrode 111.

When the upper wire cleaner 26 is pressed against the wire electrode 111, the wire electrode 111 is moved downward. Thus, the wire electrode 111 is pressed against the lower electrode cleaner 16 and the lower wire cleaner 22.

In the present exemplary embodiment, the moving body 100 performs reciprocation in a state in which the upper wire cleaner 26, the lower electrode cleaner 16, and the lower wire cleaner 22 are pressed against the wire electrode 111, and in addition, in a state in which the grid cleaner 20 is pressed against the grid electrode 29.

By this, the wire electrode 111 and the grid electrode 29 are cleaned. When the cleaning of the wire electrode 111 and the grid electrode 29 is terminated, the moving body 100 returns to the home position.

Moreover, in the present exemplary embodiment, a discharge product is attached to the wire electrode 111 and the grid electrode 29. In the present exemplary embodiment, the pressed portions 19*a* (see FIG. 5) are pressed by the protrusion 6*a* of the shaft 6, which is rotated in the circumferential direction such that the moving body 100 is moved in the front-rear direction, and as a result, the discharge product is removed by the upper wire cleaner 26, the lower electrode cleaner 16, the lower wire cleaner 22, and the grid cleaner 20.

Figure 8:
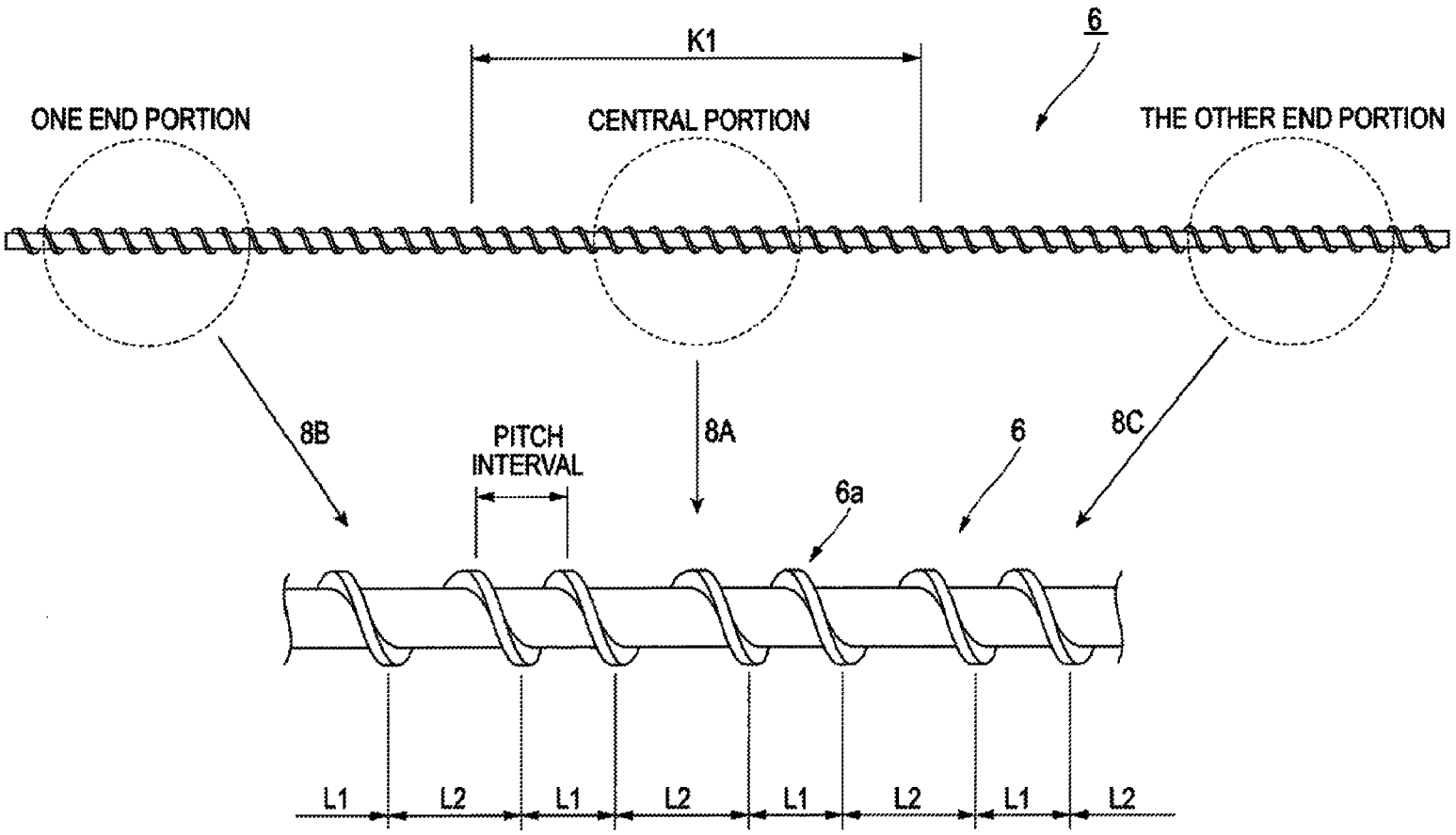
FIG. 8 is a view for explaining the configuration of an end portion and a central portion of a shaft in the longitudinal direction.

FIG. 8 is a view for explaining the configuration of an end portion and a central portion of the shaft 6 in the longitudinal direction (axial direction).

Although the spiral protrusion 6*a* is provided on the outer circumferential surface of the shaft 6 in the present exemplary embodiment, pitch intervals of the protrusion 6*a* are not constant, and the protrusion 6*a* is provided on the central portion of the shaft 6 in the longitudinal direction such that plural kinds of pitch intervals of the protrusion 6*a* are provided as represented by reference numeral 8A. More specifically, the protrusion 6*a* is provided on at least a portion, which has a length of one-third the total length of the shaft 6 (i.e. a portion indicated by reference numeral K1 in the drawing), in the central portion of the shaft 6 in the longitudinal direction such that plural kinds of pitch interval of the protrusion 6*a* are provided.

Specifically, the protrusion 6*a* is disposed on the central portion of the shaft 6 in the longitudinal direction at two pitch intervals including a pitch interval L1 (e.g., 6 mm) and a pitch interval L2 (e.g., 7 mm) greater than the pitch interval L1.

In addition, in the present exemplary embodiment, as indicated by reference numerals 8B and 8C, the protrusion 6*a* is provided such that the pitch interval L1 and the pitch interval L2 are also provided alternately on both end portions of the shaft 6 in the longitudinal direction, and plural kinds of pitch intervals of the protrusion 6*a* are also provided on both end portions of the shaft 6 in the longitudinal direction.

That is, in the present exemplary embodiment, plural kinds of pitch intervals of the protrusion 6*a* are provided in the entire region of the shaft 6 in the longitudinal direction.

In addition, in the example illustrated in FIG. 8, the protrusion 6*a* is disposed such that adjacent pitch intervals are different from each other in the longitudinal direction of the shaft 6.

More specifically, in the present exemplary embodiment, one pitch interval (a pitch interval L1) and the other pitch interval (a pitch interval L2) at a position adjacent thereto are different from each other in the longitudinal direction of the shaft 6.

In the present exemplary embodiment, the moving body 100 is moved as the shaft 6 is rotated in the present exemplary embodiment. Under this circumstance, when the pitch intervals of the protrusion 6*a* are only one kind, the wear of the moving body 100 may be concentrated at a specific position of the moving body 100 so that a deep groove may be formed in the moving body 100.

More specifically, an apex portion 6*s* of the protrusion 6*a* (see FIG. 5) and the inner circumferential surface of the shaft penetration portion 19 are rubbed on each other in the present exemplary embodiment. When the pitch intervals of the protrusion 6*a* are one kind, a groove, into which the protrusion 6*a* is inserted, is easily formed on the inner circumferential surface.

In addition, in this case, frictional force acting between the moving body 100 and the shaft 6 increases so that the moving body 100 is hardly moved. In addition, the moving body 100 is tilted so that the moving body 100 is hardly moved. In some cases, the moving body 100 is stopped.

In contrast, in the present exemplary embodiment, plural kinds of pitch intervals of the protrusion 6*a* are provided, and positions at which wear occurs inside the moving body 100 are dispersed. In addition, in this case, the groove described above is hardly formed, or even if the groove is formed, the groove is shallow so that the moving body 100 is easily moved.

In addition, when the groove is hardly formed or the groove is shallow as in the present exemplary embodiment, the reuse of the moving body 100 is enabled as well. More specifically, the moving body 100 removed from the disused charging device 13 may be reused in another charging device.

Here, in the present exemplary embodiment, both end portions of the shaft 6 are supported, and the vibration of the shaft 6 increases in the central portion of the shaft 6 in the longitudinal direction. In such a case, when the moving body 100 passes through the central portion of the shaft 6 in the longitudinal direction, load applied from the protrusion 6*a* to the moving body 100 increases, which causes the moving body 100 to be easily worn.

When the protrusion 6*a* is disposed at plural kinds of pitches on the central portion in the longitudinal direction as in the present exemplary embodiment, wear of the moving body 100 is effectively reduced.

In addition, in the present exemplary embodiment, as described above, one pitch interval and the other pitch interval at a position adjacent thereto in the longitudinal direction of the shaft 6 are different from each other, which makes the moving body 100 more hardly worn.

When the same two pitch intervals are adjacent to each other in the longitudinal direction of the shaft 6 (when two or more same pitch intervals are successive without being switched to a different pitch interval per each pitch), wear of the moving body 100 at the same position is facilitated and becomes easy, compared to the case where a pitch interval is switched to a different pitch interval per each pitch.

In addition, a case where the protrusion 6*a* is provided at two kinds of pitch intervals has been described above by way of example. However, the kinds of pitch intervals are not limited to two kinds, and may be three kinds or more.

Figure 9:
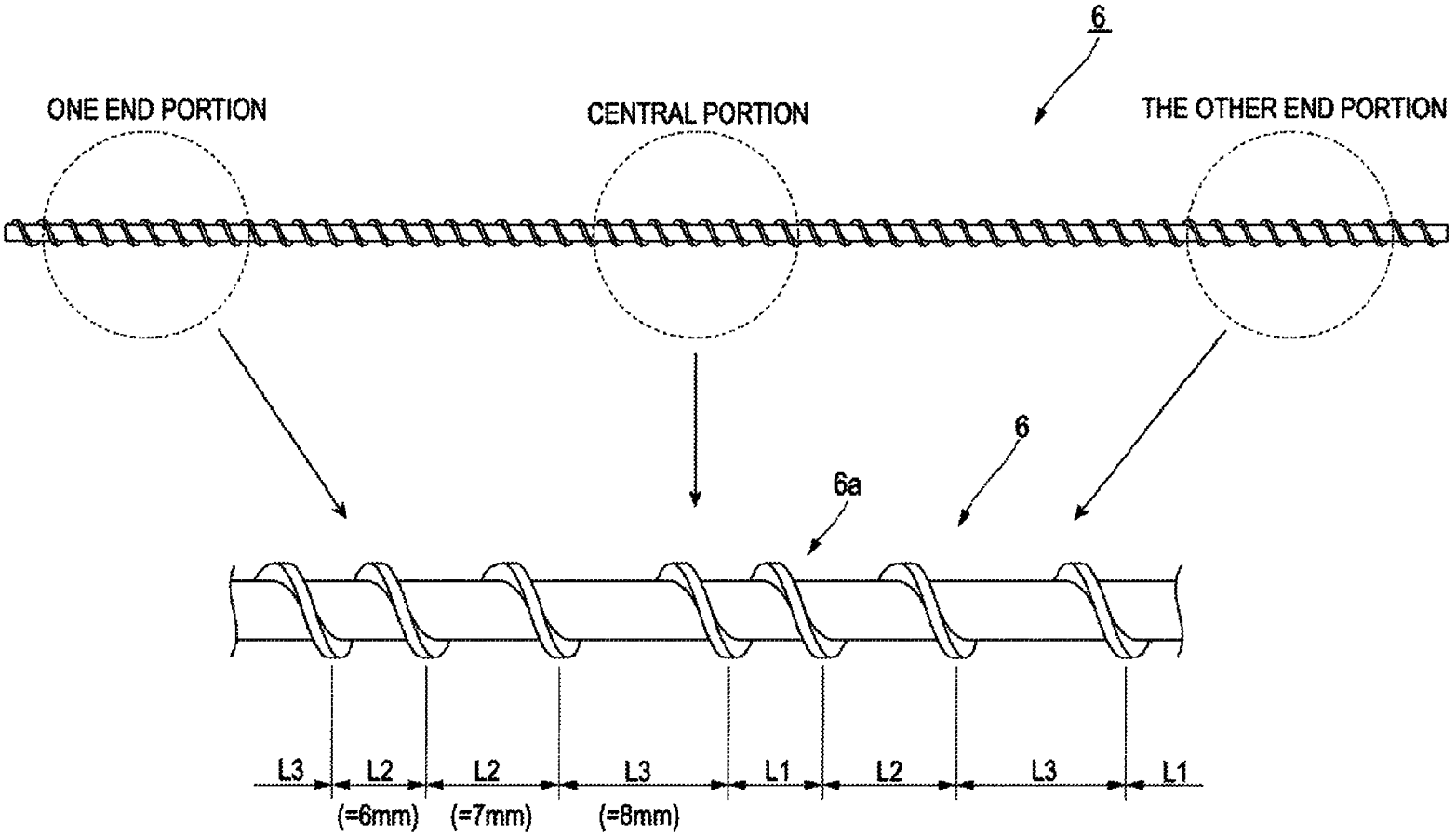
FIG. 9 is a view illustrating another configuration example of the shaft.

FIG. 9 (a drawing illustrating another configuration example of the shaft 6) illustrates the case where the protrusion 6*a* is provided at three kinds of pitch intervals. In this example, the protrusion 6*a* is disposed at a pitch interval L1 (e.g., 6 mm), a pitch interval L2 (e.g., 7 mm), and a pitch interval L3 (e.g., 8 mm).

In addition, in the example illustrated in FIG. 9, as described above, the protrusion 6*a* is disposed such that the adjacent pitch intervals are different from each other in the longitudinal direction of the shaft 6.

In addition, in the example illustrated in FIG. 9, three kinds of pitch intervals are provided on both end portions as well as the central portion of the shaft 6 in the longitudinal direction.

In addition, in the example illustrated in FIGS. 8 and 9, the protrusion 6*a* is formed such that the pitch intervals of the protrusion 6*a* are periodically changed as it advances in one direction in the longitudinal direction of the shaft 6. In this case, it is easy to manufacture the shaft 6, compared to the case where the pitch intervals are randomly changed.

As described above, the shaft 6 of the present exemplary embodiment is manufactured by winding the wire material around the outer circumferential surface of the bar-shaped member. Thus, it becomes easy to manufacture the shaft 6 (to the wire material around the bar-shaped member) when the protrusion 6*a* is provided such that the pitch intervals are periodically changed, compared to a case where the pitch intervals are randomly changed.

In addition, in the example illustrated in FIG. 9, the difference between the maximum pitch interval and the minimum pitch interval is set to be equal to or larger than the width of the protrusion 6*a*.

More specifically, in the example illustrated in FIG. 9, the maximum pitch interval is set to 8 mm, the minimum pitch interval is set to 6 mm, the width of the protrusion 6*a* (the outer diameter of the wire material) is set to 1 mm so that the difference between the two pitch intervals [2 mm (=8 mm−6 mm)] is set to be equal to or larger than the width (1 mm) of the protrusion 6*a*.

Thus, wear generated by the moving body 100 is dispersed to a wider range, compared to the case where the difference between the maximum pitch interval and the minimum pitch interval is less than the width of the protrusion 6*a*. In addition, in this case, a groove is hardly formed in the moving body 100, or even if a groove is formed, the groove is shallow. Thus, the moving body 100 is easily moved.

In addition, in the example illustrated in FIG. 8, when the pitch interval L1 is set to, for example, 6 mm, the pitch interval L2 is set to, for example, 8 mm, and the outer diameter of the wire material is set to 1 mm, the difference between the maximum pitch interval and the minimum pitch interval becomes equal to or larger than the width of the protrusion 6*a*, as illustrated in FIG. 9.

In addition, the difference between the maximum pitch interval and the minimum pitch interval is not particularly limited, but is set to a value, for example, in a range greater than 0.5 mm and less than 2 mm.

In addition, the width of the protrusion 6*a* (the diameter of the wire material) is not particularly limited, but is set to a value, for example, in a range of 0.5 mm to 3 mm.

In addition, as described above, it may be more desirable to set one pitch interval and the other pitch interval at a position adjacent thereto in the longitudinal direction of the shaft 6 to be different from each other. However, as illustrated in FIG. 10 (the drawing illustrating another configuration example of the shaft 6), a portion in which one pitch interval and the other pitch interval at a position adjacent thereto is equal to each other may exist.

Figure 10:
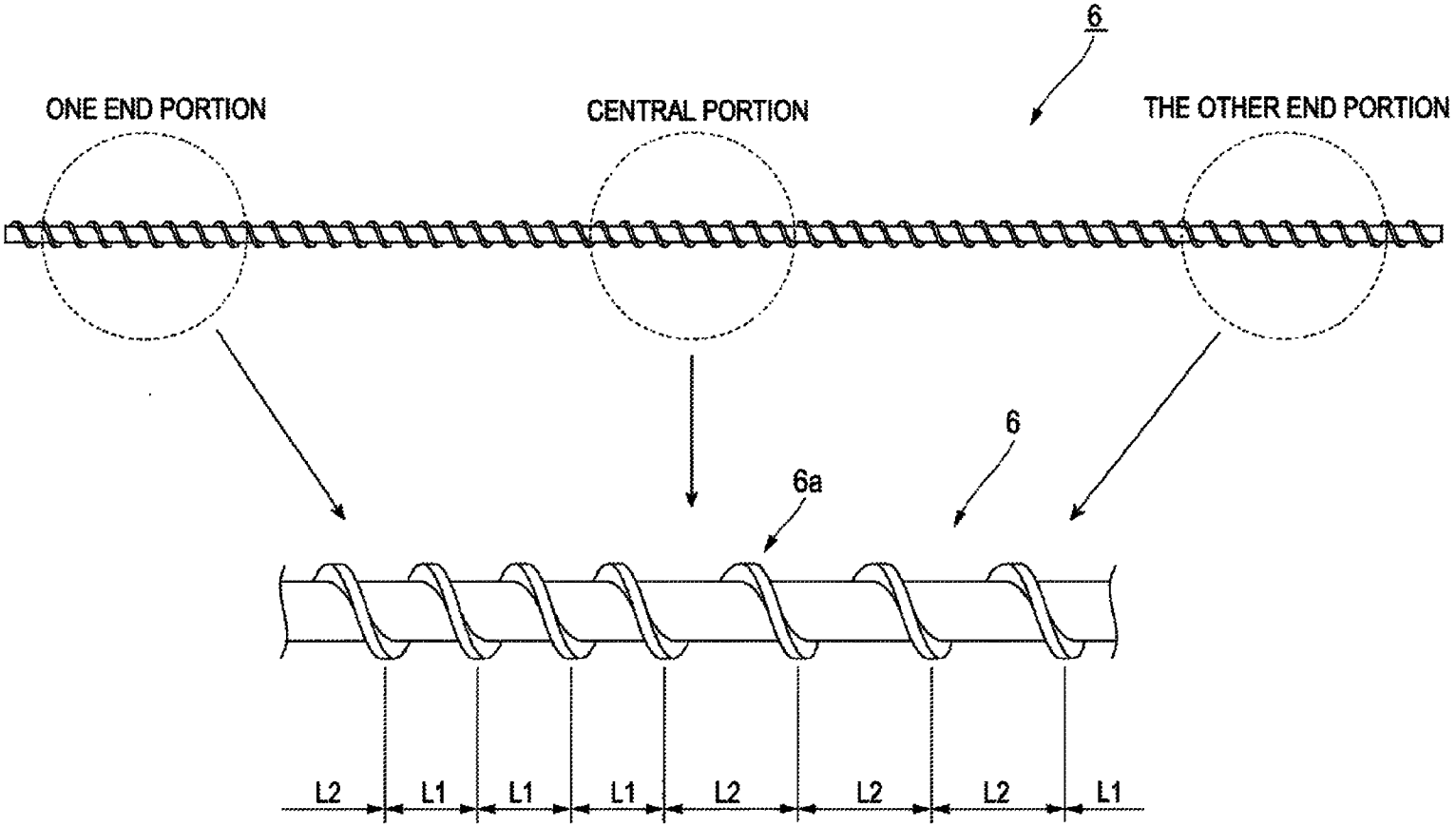
FIG. 10 is a view illustrating another configuration example of the shaft.

In the example illustrated in FIG. 10, three pitch intervals L1, which are one kind of pitch interval, and three pitch intervals L2, which are another kind of pitch interval, are formed alternately provided in the longitudinal direction of the shaft 6.

EXAMPLE

Figure 11A:
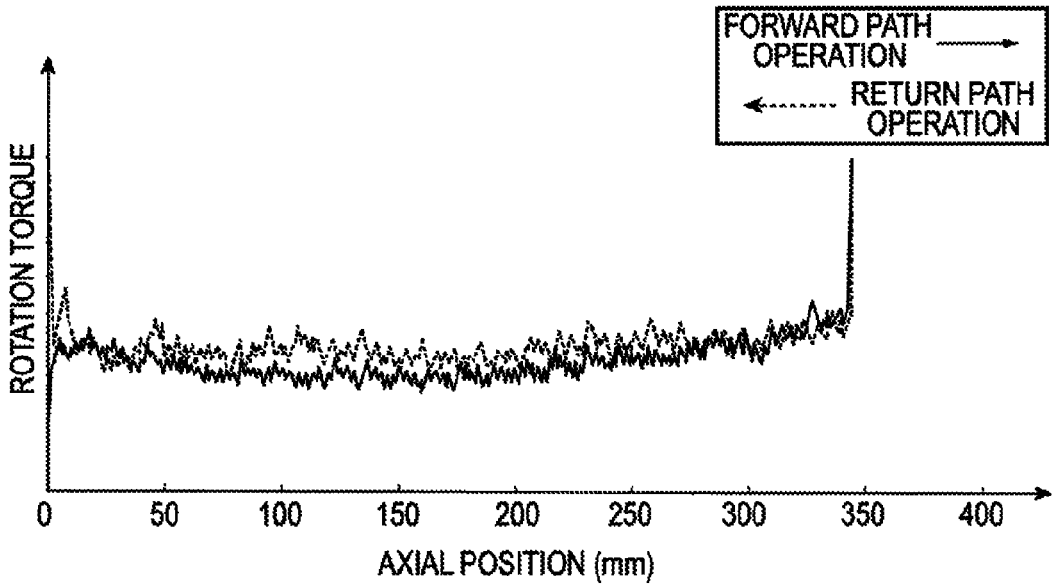
FIGS. 11A and 11B are views illustrating a rotation torque when the moving body is moved by using the shaft of the present exemplary embodiment.
Figure 11B:
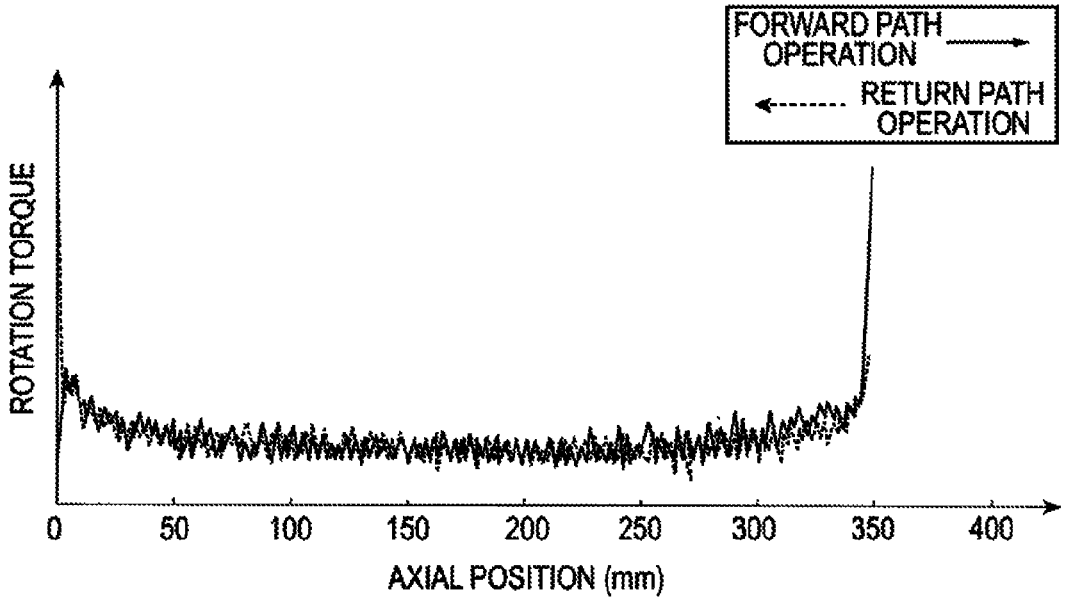

FIGS. 11A and 11B are views illustrating a rotation torque when the moving body 100 is moved by using the shaft 6 illustrated in FIG. 8.

FIG. 11A illustrates a rotation torque when the initial reciprocation is performed by the moving body 100. In addition, FIG. 11B illustrates a rotation torque when the 60th reciprocation is performed by the moving body 100. In addition, in each of FIGS. 11A and 11B, a rotation torque in a forward path is illustrated by a solid line, and a rotation torque in a return path is illustrated by a broken line.

In this example, while a slight variation in rotation torque occurs at the initial reciprocation as illustrated in FIG. 11A, the variation in rotation torque is almost eliminated at the 60th reciprocation as illustrated in FIG. 11B.

Because the protrusion 6*a* is disposed at plural kinds of pitch intervals in the present exemplary embodiment, the inner circumferential surface of the shaft penetration portion 19 (see FIG. 5) is worn over a wide range when the reciprocation of the moving body 100 is repeated.

In addition, in this case, the inner circumferential surface of shaft penetration portion 19 becomes smoother after the reciprocation of the moving body 100 is repeated, compared to the inner circumferential surface where the initial reciprocation is performed by the moving body 100.

Accordingly, in the present example, the moving body 100 is more smoothly moved after the reciprocation of the moving body 100 is repeated, compared to the initial reciprocation of the moving body 100.

Comparative Example

Figure 12A:
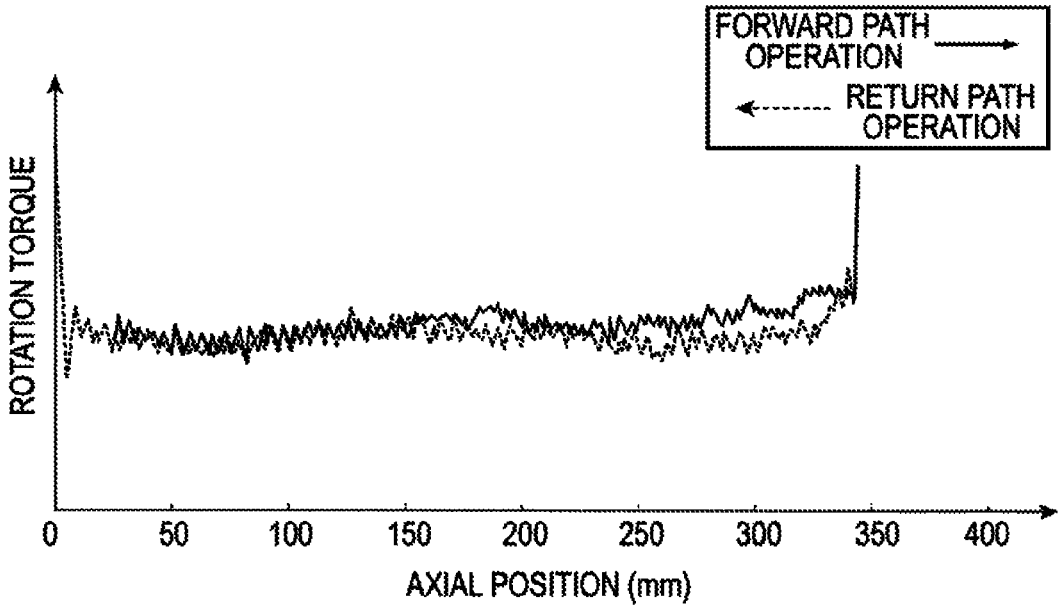
FIGS. 12A and 12B are views illustrating a rotation torque when the moving body is moved by using a shaft of a comparative example.
Figure 12B:
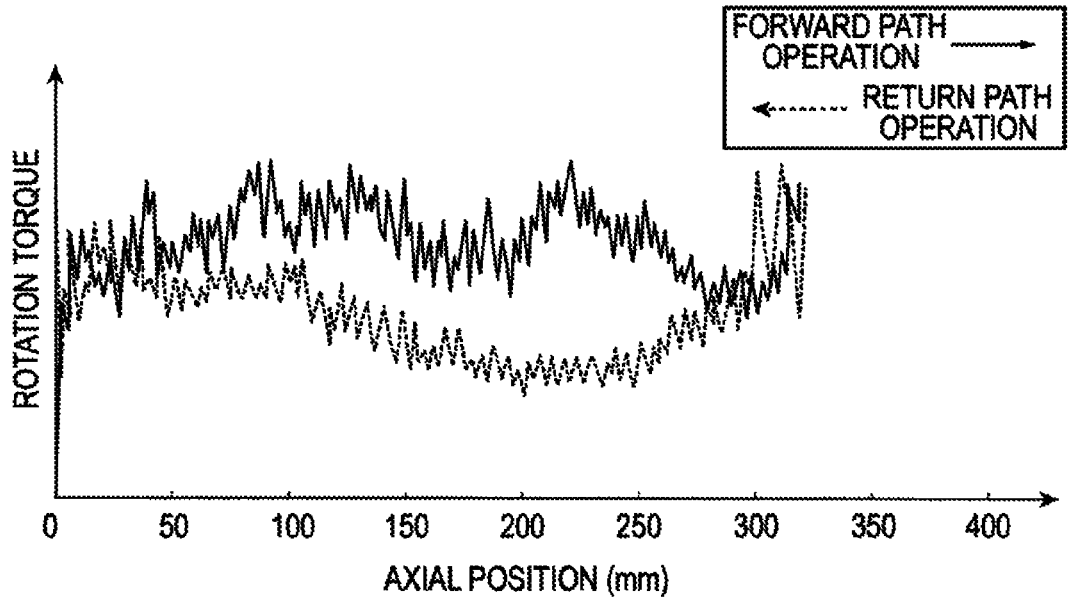

FIGS. 12A and 12B are views illustrating a rotation torque when the moving body 100 is moved by using the shaft 6 of a comparative example. Specifically, the drawings illustrate a rotation torque when the moving body 100 is moved by using the shaft 6 on which the protrusion 6*a* is disposed at the pitch interval (one kind of pitch interval) of 6 mm. In addition, FIG. 12A illustrates a rotation torque when the initial reciprocation is performed by the moving body 100. In addition, FIG. 12B illustrates a rotation torque upon the 13th reciprocation is performed by the moving body 100.

While a slight variation in rotation torque occurs when the initial reciprocation is performed as illustrated in FIG. 12A, the degree of variation in rotation torque is not greatly changed from the result illustrated in FIG. 11A (the degree of variation in the present exemplary embodiment).

In contrast, when the 13th reciprocation is performed, the rotation torque is greatly changed as illustrated in FIG. 12B. In this case, the moving body 100 may be hardly moved, or the moving body 100 may be stopped.

Figure 13:
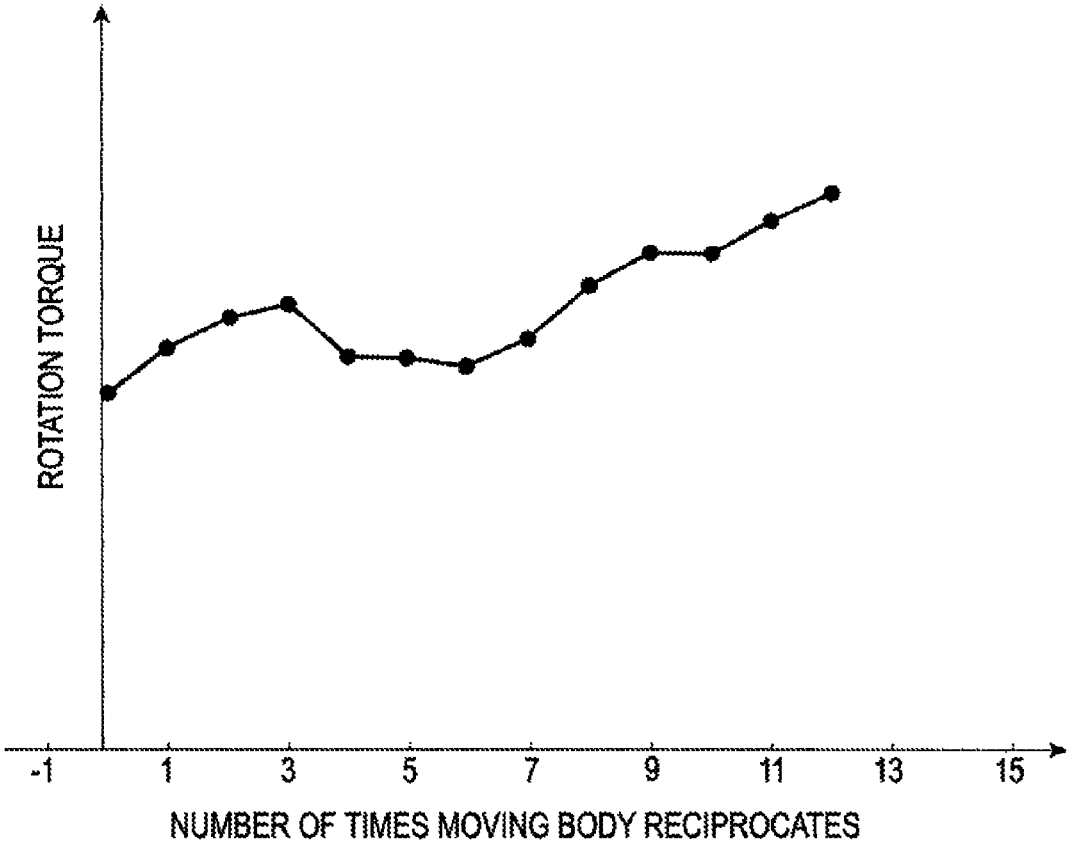
FIG. 13 is a view illustrating the progress of a rotation torque required to move the moving body by using the shaft of the comparative example.

FIG. 13 is a view illustrating the progress of a rotation torque required when the moving body 100 is moved by using the shaft 6 of the comparative example. In addition, in FIG. 13, the horizontal axis represents the number of times the moving body 100 reciprocates, and the vertical axis represents a rotation torque required when the moving body 100 is moved along a forward path.

In addition, a rotation torque for each forward path movement is an average value of a rotation torque required when the moving body 100 passes the central portion of the shaft 6 in the longitudinal direction, a rotation torque required when the moving body 100 passes one end portion of the shaft 6, and a rotation torque required when the moving body 100 passes the other end portion of the shaft 6.

As illustrated in FIG. 13, in this comparative example, when reciprocation movements are repeated, a rotation torque increases. Although a rotation torque for each reciprocation-path movement is temporarily reduced from the 4th reciprocation-path movement to the 7th reciprocation-path movement, the rotation torque again increases after the 8th reciprocation-path movement. Thus, a final rotation torque (i.e. a rotation torque upon 12th reciprocation-path movement) becomes greater than a rotation torque upon the 1st reciprocation-path movement.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging device comprising:

an electrode;

a cleaning member that cleans the electrode;

a moving body that moves along the electrode, the cleaning member that is attached to the moving body; and a rotation member that is disposed along the electrode and that includes a spiral protrusion on an outer circumferential surface thereof to move the moving body, the rotation member that is rotated in a circumferential direction, wherein a plurality of kinds of pitch intervals of the protrusion are provided on at least a central portion of the rotation member in a longitudinal direction.

2. The charging device according to claim 1, wherein the plurality of kinds of pitch intervals of the protrusion are provided on both end portions of the rotation member in the longitudinal direction.

3. The charging device according to claim 1, wherein the plurality of kinds of pitch intervals of the protrusion are provided over an entire region of the rotation member in the longitudinal direction.

4. The charging device according to claim 1, wherein the pitch intervals of the protrusion are periodically changed.

5. The charging device according to claim 1, wherein a difference between a maximum pitch interval and a minimum pitch interval is equal to or larger than a width of the protrusion.

6. The charging device according to claim 1, wherein one pitch interval and a pitch interval at a position adjacent to the one pitch interval in the longitudinal direction of the rotation member are different from each other.

7. An image forming apparatus comprising:

an image carrier that is provided rotatably;

an electrode that is disposed at a position opposite to an outer circumferential surface of the image carrier and that extends in an axial direction of the image carrier;

a cleaning member that cleans the electrode;

a moving body that moves along the electrode, the cleaning member that is attached to the moving body; and a rotation member that is disposed along the electrode and that includes a spiral protrusion on an outer circumferential surface thereof to move the moving body, the rotation member that is rotated in a circumferential direction, wherein a plurality of kinds of pitch intervals of the protrusion are provided on at least a central portion of the rotation member in a longitudinal direction.

* * * * *